United States Patent [19]

Hoekstra

[11] Patent Number: 4,918,905

[45] Date of Patent: Apr. 24, 1990

[54] METHOD AND DEVICE FOR PACKAGING AN ELONGATE BODY

[75] Inventor: Frans Hoekstra, Diepenveen, Netherlands

[73] Assignee: Thomassen & Drijver-Verblifa N.V., Netherlands

[21] Appl. No.: 212,677

[22] Filed: Jun. 28, 1988

[30] Foreign Application Priority Data

Jul. 3, 1987 [NL] Netherlands ..... 8701576

[51] Int. Cl.[5] ..... B65B 11/16

[52] U.S. Cl. ..... 53/411; 53/137; 53/229; 53/378; 53/415

[58] Field of Search ..... 53/416, 415, 137, 128, 53/229, 230, 228, 371, 374, 378, 480, 481, 482, 411, 131; 493/308

[56] References Cited

U.S. PATENT DOCUMENTS

| | | | |
|---|---|---|---|
| 1,772,823 | 8/1930 | Anderson . | |
| 2,797,370 | 6/1957 | Bennett | 53/415 X |
| 2,829,791 | 4/1958 | Berst | 53/415 |
| 3,466,843 | 9/1969 | Mumper | 53/137 |
| 4,227,955 | 10/1980 | Woods et al. | 53/137 X |
| 4,669,248 | 6/1987 | Vrind et al. | 53/229 |

FOREIGN PATENT DOCUMENTS

| | | |
|---|---|---|
| 0206374 | 4/1987 | European Pat. Off. . |
| 951268 | 3/1964 | United Kingdom . |

*Primary Examiner*—James F. Coan

*Attorney, Agent, or Firm*—Watson, Cole, Grindle & Watson

[57] ABSTRACT

The invention relates to a method and apparatus for packing an elongated body, for example a stack of covers or lids, by wrapping the body and folding the protruding portion of the wrapper from two opposing sides relative to each of the end faces such that two tapering flaps are formed and then applying a sealing tape to only the two tapering flaps.

18 Claims, 1 Drawing Sheet

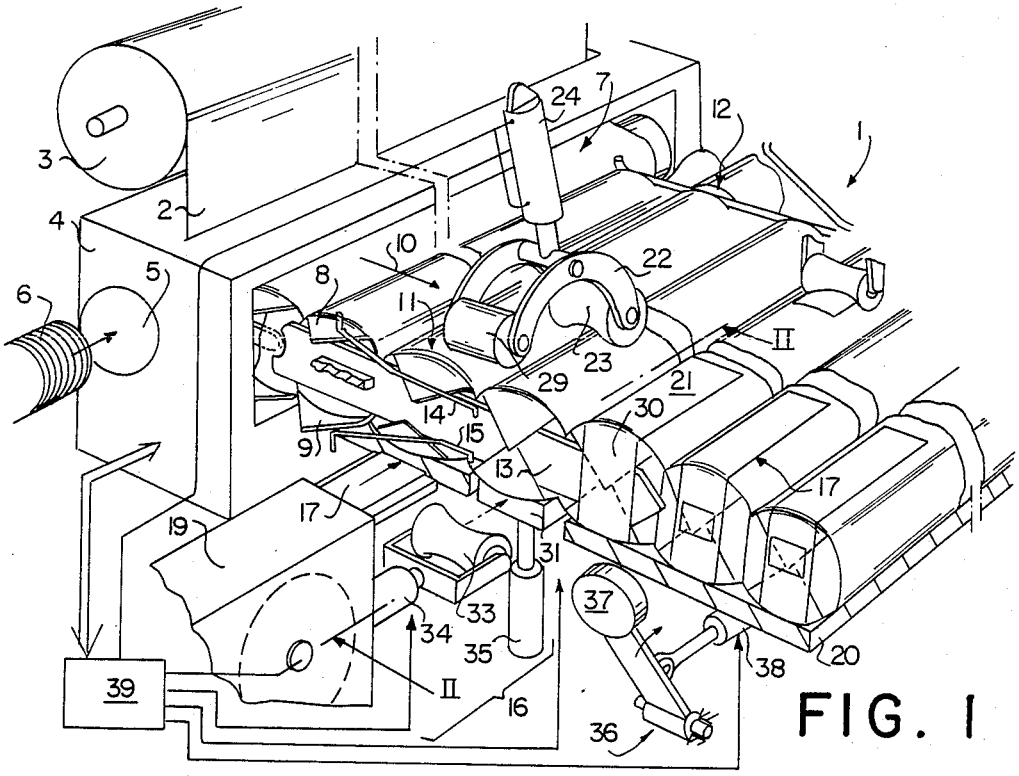
FIG. 1
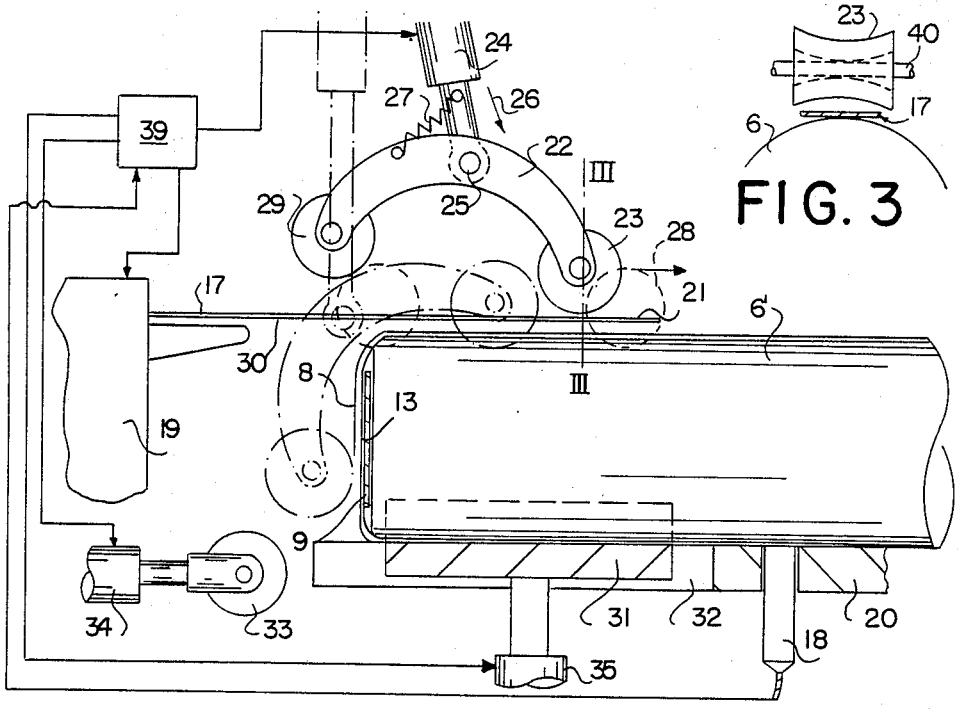
FIG. 2
FIG. 3

METHOD AND DEVICE FOR PACKAGING AN ELONGATE BODY

BACKGROUND AND SUMMARY OF THE INVENTION

The invention relates to a method for packaging an elongate body, for example a stack of covers, comprising the following steps:

the providing of an elongate body for packaging;

the providing of a sheet of packaging material;

the wrapping of the body with the sheet of packaging material such that the sheet protrudes over a predetermined distance beyond at least one outer end of the body;

the folding over of the protruding part from two opposing sides to the relevant end face of the body such that two tapering flaps are formed, in addition to a device for performing this method, which device comprises:

means for supplying the body, means for supplying the sheet of packaging material, means for wrapping of the body with the sheet of packaging material such that the sheet protrudes over a predetermined distance beyond at least one outer end of the body;

folding means for folding over of the protruding part from two opposing sides to the relevant end face of the body such that two tapering flaps are formed.

Such a method and device are known from U.S. Pat. No. 4,669,248.

The invention has for its object to offer a method and device, using which a loop-shaped portion is present at at least one end of a packed body. The presence of such a loop can have the very practical advantage that the packed body is easily taken hold of, lifted up, transported and the like by an operative using two fingers or by a tool, while the loop further offers an easy gripping point for tearing open the packaging, something which has been a source of problems up to the present time, particularly in the case of packed stacks of covers.

In order to achieve this the invention proposes a method which adds the following step to those stated above: the connecting substantially to each other only of these two flaps. The above-mentioned device for performing the method is characterized in this respect by connecting means for connecting of these two flaps substantially to each other only.

The flaps can be joined to each other by stapling, glueing or other known techniques. Preferred, however, is the method in accordance with which the flaps are joined to each other by adhesive tape. Since in lengthwise direction the flaps lie a little further to the outside than the portion of the sheet of packaging material lying underneath, it is very easy to achieve hereby that only the flaps are joined to each other and remain joined.

A great strength of the loop and if necessary a greater reliability of the connection between the flaps is obtained with an embodiment of the method which has the feature that the strip of adhesive tape is applied such that it extends over both flaps and a part of the peripheral surface of the packaged elongate body.

Known from the above-mentioned U.S. patent is a device with conveyor means for transporting a wrapped body transversely to the longitudinal direction thereof after it has left the wrapping means, which conveyor means lead a wrapped body along the folding means such that the free ends of the two tapering flaps are situated in a plane lying transversely of the conveying direction. In accordance with the invention this device is now characterized by a tongue extending between both flaps along the path defined by the conveyor means of the relevant end surface of the body, close to the side edges of which tongue, on the side away from the said path, fold guidings extend, which, as seen in the conveying direction, display a decreasing distance to the tongue such that the flaps of a supplied body are trained between the fold guidings and the tongue and are folded over to the relevant end face of the body; and an adhesive tape station placed beyond the downstream end of the fold guidings, which station applies over the flaps of each body carried past by the conveyor means an adhesive strip, the strip extending in its longitudinal direction transversely of the transporting direction.

Very effective is the use of roller means for rolling press-on of the adhesive strip. Such a device can display the particular feature that the adhesive tape station delivers an adhesive strip of predetermined length and applies a first portion of this adhesive strip over the end zone of the wrapped body adjacent to the flap;

the roller means comprise:

a first roll which can roll under pressure over that first end portion;

a second roll which can then roll under pressure over a central portion of the adhesive strip such that it adheres to the flaps; and a third roll which can subsequently roll under pressure over the remaining end portion of the adhesive strip over the end zone adjacent to the other flap.

Such a device can in particular be embodied such that the first and second rolls are attached to both ends of a rocker arm that can be displaced at least roughly transversely of the conveying direction and the lengthwise direction of the body by means of displacing means, this arm being biased such that at the beginning of an adhesive tape application cycle the first roll is first operative and the second roll is placed relative to the flaps to be joined to each other such that it rolls under pressure with the increasing displacement of the displacement means over the flaps via the centre portion of the adhesive strip.

In order to realize the most effective possible press-on by the roller means and thereby adhesion of the adhesive tape to the packaging material, the device preferably displays the feature that each of the rolls possesses a form adapted to the shape of the relevant surface of the wrapped body. Since the form and the positioning of a wrapped elongate body may vary a little from case to case, a variant can advantageously be employed in which each of the rolls is capable of a certain free pivoting.

A preferred embodiment has the special feature that the conveyor means comprise a supporting face in which is situated at the location of the adhesive tape station a recess for the third roll. Preferably use is also made in this case of a displaceable support which, during the operation of the first roll, supports the end zone of the body above the recess and which is subsequently removed from this position to enable operation of the third roll.

In order to enable printing on the loop formed according to the invention on at least one end of the packed elongate body, use can be made of a printing station placed downstream relative to the connecting means for applying printed information, for example an article code, to an end face of a packaged body.

The invention will now be elucidated with reference to the accompanying drawings.

BRIEF DESCRIPTION OF THE DRAWINGS

FIG. 1 shows a schematic, perspective view of an important part of a device according to the invention;

FIG. 2 shows the cross section II—II in FIG. 1; and

FIG. 3 shows the cross section III—III in the FIGS. 1 and 2.

DETAILED DESCRIPTION OF THE PREFERRED EMBODIMENT

FIG. 1 shows a device 1 for wrapping elongate bodies 6 in a sheet 2 of packaging material which is unrolled from a supply roll 3 and fed into a wrapping device 4 wherein elongate gate bodies 6 fed in successively via an inlet 5 are wrapped with the sheet 2 of packaging material. The width of sheet 2 is greater than the length of a supplied body 6 so that when wrapping takes place the sheet protrudes a certain distance beyond (in this case) both end faces of body 6. Via a discharge opening 7 the thus-wrapped bodies 6 are transported to the outside by means of discharge means present in the wrapping device 4. Before the wrapped bodies 6 are transported to the outside via discharge opening 7 they are processed by folding means for folding over of the protruding portion of the sheet of packaging material from two opposing sides to the end faces of the body 6, such that two pointed tapering flaps result, an upper flap 8 and a lower flap 9.

The wrapping device 4, which is described in detail in U.S. Pat. No. 4,669,248, also comprises conveyor means for transporting a folded body transversely of the lengthwise direction thereof after it has left the wrapping means, which conveyor means guide a wrapped body 6 along the folding means such that the free end of the two tapering flaps 8, 9 are located in a plane lying transversely of the conveying direction 10. The conveying direction lies in this case in a horizontal plane and the pointed ends of flaps 8, 9 are located in a vertical plane.

The device 1 comprises a tongue 13 extending between both flaps 8, 9 along the path of each end face 11, 12 of a wrapped body 6, and extending close to the longitudinal edges of this tongue of the side facing away from the noted path are two fold guidings 14, 15, which display a decreasing distance to the tongue 13 in the direction downstream of the in-feed side, such that the flaps 8, 9 of a supplied, wrapped body 6 are trained between on one side the respective fold guidings 14, 15 and on the other the longitudinal edges of tongue 13 and are folded over to the relevant end face 11 of that body 6. Present beyond the downstream end of these fold guidings 14, 15 is an adhesive tape station 16 to be described hereinafter. This adhesive tape station is executed such that it applies over the flaps 8, 9 of a passing wrapped body 6 an adhesive strip which extends in its lengthwise direction transversely of the conveying direction 10.

Reference is also made in the following description of the adhesive tape station to FIGS. 2 and 3.

An adhesive tape delivery device 19 delivers an adhesive strip 17 of predetermined length, after a presence detector 18 has ascertained the presence of a wrapped body 6 on a support table 20 at this location. The adhesive tape delivery device 19 applies the adhesive strip 17 with a first end portion 21 over the end zone of the wrapped body 6 adjacent to the flap 8. FIG. 2 shows this particularly clearly.

By means of a first roll 23 carried by a rocker arm 22 this first end portion can be adhered using a selected pressure onto the periphery of the wrapped body 6. To this end the rocker arm is attached for pivoting to a pneumatic cylinder 24 which can be actuated for this purpose, with the result that the pivoting point 25 of rocker arm 22 is displaced in the direction of the arrow 26. The rocker arm 22 that is under bias of a draw spring 27 is also moved downward as a result, causing the first roll 23 to come into contact with the first end portion. Roll 23 then rolls first a little to the right (see arrow 28), following which, as the pivoting point 25 is increasingly displaced in the direction of arrow 26, a gradual tilting of rocker arm 22 occurs, as a result of which a second roll 29 is moved downward and comes into contact with the centre portion 30 of adhesive strip 17 which is thereby moved downward and adhered over the flaps 8 and 9. This situation is shown with broken lines. The rocker arm 22 in this position is indicated with 22. The rocker arm is formed such that both rolls 23 and 29 are simultaneously in contact with the wrapped body 6. During press-on by roll 23 onto the associated end zone of wrapped body 6 the latter is supported by a support plate 31 which can be moved up and down by means of a cylinder 35, for instance a pneumatic cylinder. In the situation shown in the FIGS. 1 and 2 the support plate is located in an opening 32 in the bearing table 20. This opening serves to ensure that a third roll 33 can fulfil the same function on the underside of the wrapped body 6 as the first roll 23 on the upper side thereof. Following the action of roll 29 a second hanging end portion of the adhesive strip 17 is still present on the lower flap 9. By moving this third roll to the right through actuation of a pneumatic cylinder 34, this end portion of the adhesive strip is likewise applied against the wrapping of the wrapped body 6.

After the support plate 31 has been moved downward through relevant actuation by the cylinder 35, the opening 32 is freely accessible for passage of the third roll 33, whereby the adhering process is completed.

Thus is achieved, as FIG. 1 shows, that a more or less U-shaped adhesive strip 17 extends over an end face and the periphery of a wrapped body 6.

It will be apparent from FIG. 1 that the tongue 13 extends beyond the adhesive tape station 16. This prevents the adhesive tape adhering to the packaging material of the relevant end face of the wrapped body 6 present next to the flaps 8 and 9.

Placed downstream relative to adhesive tape station 16 is a printing station 36 for applying printed information, for example an article code, serial number and the like, to the central portion 30 of the adhesive strip 17 of a packaged body 6. It is remarked in this respect that in known devices such coding is applied to the envelope cylinder of a packed body.

The printing station comprises a pivoting stamping member 37 which can perform a printing operation under the control of a pneumatic cylinder 38.

The cycle described takes place under the control of a central control unit 39. This latter is in information exchanging contact with the wrapping device 4, receives data from the presence detector 18 and controls the operation of the adhesive tape station 16, that is, the adhesive tape delivery device 19, the pneumatic cylinder 24, the pneumatic cylinder 34 and the pneumatic cylinder 35. The central control unit also controls the pneumatic cylinder 38.

The first roll 23 and the third roll 33 display, as will be seen in FIG. 1 and FIG. 3 in particular, a form adapted to the shape of the envelope cylinder of the wrapped body 6. The second roll 29 is cylindrical in form and thereby likewise adapted to the form of the end face to be brought into co-action with this roll 29.

As FIG. 3 shows in the case of the roll 23, each of the rolls 23, 29, 33 is capable of a certain amount of free pivoting. For this purpose the through-bore in roll 23 is in this embodiment more or less double-cone shaped. This free pivoting has the advantage that the position of the roll can adapt to some extent to the more or less variable position and shape of the body 6 for handling.

The above description relates to the processing of an elongate body on one side. Shown already in FIG. 1 is that the device 1 is operative on both sides, although this is not indicated with reference numerals. With a two-sided embodiment both ends of a body for packaging may be handled differently in so far that the adhesive tape can easily be broken on one side for opening of the packaging, for example by using paper adhesive tape, while on the other side a stronger connection is used, for example by making use of strong adhesive tape made from plastic. In both cases an area extends beneath both flaps that is easily accessible and sufficiently large to allow insertion of a finger, either to carry a packed body in vertical manner, and thus in hanging position, or to exert a tearing force.

I claim:

1. Method for packaging an elongate body, for example a stack of covers, comprising the following steps:

the providing of an elongate body for packaging;

the providing of a sheet of packaging material;

the wrapping of said body with said sheet of packaging material such that said sheet protrudes over a predetermined distance beyond at least one outer end of said body;

the folding over of the protruding part from two opposing sides to the relevant end face of said body such that two tapering flaps are formed; characterized by the following step;

the joining of these two flaps substantially to each other only.

2. Method as claimed in claim 1, characterized in that the flaps are joined to each other by adhesive tape.

3. Method as claimed in claim 2, characterized in that the strip of adhesive tape is applied such that it extends over both flaps and a part of the peripheral surface of the packed elongate body.

4. Device for packaging an elongate body in a sheet of packaging material, which device comprises:

means for supplying the body, means for supplying the sheet of packaging material, means for wrapping of said body with said sheet of packaging material such that said sheet protrudes over a predetermined distance beyond at least one outer end of said body;

folding means for folding over of the protruding part from two opposing sides to the relevant end face of said body such that two tapering flaps are formed, characterized by connecting means for joining of these two flaps substantially to each other only.

5. Device as claimed in claim 4, with conveyor means for transporting a wrapped body transversely to the longitudinal direction thereof after it has left the wrapping means, which conveyor means lead a wrapped body along the folding means such that the free ends of the two tapering flaps are situated in a plane lying transversely of the conveying direction;

characterized by a tongue extending between both flaps along the path defined by the conveyor means of the relevant end surface of the body, close to the side edges of which tongue, on the side away from the said path, fold guidings extend, which, as seen in the conveying direction, display a decreasing distance to said tongue such that said flaps of a supplied body are trained between said fold guidings and said tongue and are folded over to said relevant end face of said body; and an adhesive tape station placed beyond the downstream end of said fold guidings, which station applies over the flaps of each body carried past by the conveyor means an adhesive strip, said strip extending in its longitudinal direction transversely of the conveying direction.

6. Device as claimed in claim 5, characterized by roller means for rolling press-on of the adhesive strip.

7. Device as claimed in claim 6, characterized in that the adhesive tape station delivers an adhesive strip of predetermined length and applies a first portion of this adhesive strip over the end zone of the wrapped body adjacent to a flap;

the roller means comprise:

a first roll which can roll under pressure over that first end portion;

a second roll which can then roll under presure over a central portion of said adhesive strip such that it adheres to the flaps; and a third roll which can subsequently roll under pressure over the remaining end portion of said adhesive strip over the end zone adjacent to the other flap.

8. Device as claimed in claim 7, characterized in that the first and second rolls are attached to both ends of a rocker arm that can be displaced at least roughly transversely of the conveying direction and the lengthwise direction of the body by means of displacing means, this arm being biased such that at the beginning of an adhesive tape application cycle said first roll is operative first and said second roll is placed relative to the flaps to be joined to each other such that with the increasing displacement of the displacement means it rolls under pressure over the flaps via the centre portion of the adhesive strip.

9. Device as claimed in claim 6, characterized in that each of the rolls possesses a form adapted to the shape of the relevant surface of the wrapped body.

10. Device as claimed in claim 7, characterized in that each of the rolls is capable of a certain free pivoting.

11. Device as claimed in claim 7, characterized in that the conveyor means comprise a supporting face in which is situated a recess for the third roll at the location of the adhesive tape station.

12. Device as claimed in claim 11, characterized by a displaceable support which during the operation of the first roll supports the end zone of the body above the recess and which is subsequently removed from this position to enable operation of the third roll.

13. Device as claimed in claim 4, including a printing station placed downstream relative to the connecting means for applying printed information, for example an article code, to an end face of a packed body.

14. The method of packaging an elongate stack of discrete elements, which comprises the steps of wrapping a sheet of material around the stack to form a tube of the material encasing the stack and having a length exceeding the length of the stack so that the encasing tube projects beyond one end of the stack by an amount sufficient to exceed the radius of the stack, folding diametrically opposite portions of the projecting end of the tube against the one end of the stack to leave outwardly tapering flaps on diametric sides of the stack each having a length exceeding the radius of the stack, and then folding the tapering flaps onto each other and joining them to each other while leaving such tapering flaps substantially free from attachment to the one end on the tube.

15. The method as defined in claim 14 wherein the tapering flaps are joined by a U-shaped strip of material overlapping the tapering flaps and the one end of the tube adjacent such flaps.

16. The method as defined in claim 15 wherein the U-shaped strip is formed of adhesive material and including the steps of rolling the ends of the U-shaped strip against the outsides of the tube and against the tapering flaps at the one end thereof.

17. The method as defined in claim 15 including the step of inserting a backing tongue between the tapering flaps and the one end of the stack prior to folding the tapering flaps onto each other and joining them.

18. An apparatus for packaging a cylindrical body in a sheet of packaging material, said apparatus comprising first supply means for supplying said cylindrical body, said cylindrical body having opposite end faces, second supply means for supplying said sheet of packaging material, wrapping means for wrapping said cylindrical body with said sheet of packaging material such that an end portion of said sheet of packaging material extends beyond one of said end faces of said elongated body.

folding means for folding opposite sides of said end portion of said sheet of packing material against said one end face of said elongated body, thereby providing two underfolds and leaving two opposite, tapered flaps of packing material extending away from said one end face, cover means for covering said underfolds, guide means for bending said two opposite flaps towards each other until free ends thereof overlap and are positioned against said cover means, and adhesive tape applicator means for applying a strip of adhesive tape over said overlapping flaps to connect them together, said cover means preventing adherence of said flaps to said underfolds.

* * * * *